US005391068A

United States Patent [19]

Uppal

[11] Patent Number: 5,391,068

[45] Date of Patent: Feb. 21, 1995

[54] GEAR PUMP

[75] Inventor: Sohan L. Uppal, Bloomington, Minn.

[73] Assignee: Eaton Corporation, Cleveland, Ohio

[21] Appl. No.: 196,668

[22] Filed: Feb. 15, 1994

[51] Int. Cl.[6] ..... F01C 1/18

[52] U.S. Cl. ..... 418/206; 418/133

[58] Field of Search ..... 418/70, 133, 205, 206

[56] References Cited

U.S. PATENT DOCUMENTS

| | | | |
|---|---|---|---|
| 1,541,435 | 6/1925 | Reller . | |
| 2,346,761 | 4/1940 | Johnson . | |
| 2,649,740 | 8/1953 | Murray et al. . | |
| 3,251,309 | 5/1966 | Schmiel et al. | 418/206 |
| 3,421,412 | 1/1969 | Ackley | 418/206 |
| 3,431,862 | 3/1969 | Bottoms | 418/206 |
| 3,713,759 | 1/1973 | Pollman et al. . | |
| 4,370,110 | 1/1983 | Nagely | 418/206 |

*Primary Examiner*—Richard A. Bertsch
*Assistant Examiner*—Charles G. Freay
*Attorney, Agent, or Firm*—L. J. Kasper

[57] ABSTRACT

A gear pump (11) is disclosed of the type comprising a housing (15,17) defining gear cavities (25) in which are rotatably disposed first (27) and second (29) gears. Each of the gears includes a gear portion and a generally cylindrical portion (37,39) on one axial side of the gear. The housing defines first (41) and second (43) cylindrical, internal pilot surfaces receiving and rotatably supporting the cylindrical portions of the gears. The engagement of each cylindrical portion and its respective internal pilot surface comprises substantially the only bearing support for the gear. One gear (27) comprises a drive gear and is driven by an input shaft (23) defining a bearing portion (51) received within a cylindrical pilot surface (55) defined by the housing. With the present invention, the primary pilot surfaces which need to be concentric are all defined by the same housing member, to facilitate accurate machining thereof. The input shaft (23) is a separate piece from the drive gear (27) and its size is not limited by the size of the gears, and may be readily replaced "in the field" without substantial disassembly of the pump.

20 Claims, 2 Drawing Sheets

GEAR PUMP

BACKGROUND OF THE DISCLOSURE

The present invention relates to fluid pressure devices, such as pumps and motors, and more particularly, to gear-type fluid pressure devices.

Although the present invention may be utilized with fluid pressure devices having various types of gear elements, it is especially advantageous when used with devices of the "external gear" type, and will be described in connection therewith.

Although the present invention may be used advantageously in connection with fluid pressure devices which are being utilized as motors, it is especially adapted for devices being used as pumps, and will be described in connection therewith.

A typical, prior art, external gear pump is illustrated and described in U.S. Pat. No. 3,713,759. The prior art external gear pump typically includes a pair of meshing, straight spur gears, each of the gears being fixed to its respective shaft. The forward end of each of the shafts is journalled within journal openings defined by a housing, while the rearward end of each of the shafts is journalled within journal openings defined by an endcap. Disposed between the housing and the endcap are the meshing gears, surrounded by another housing member. The two housings and the endcap are held in tight sealing engagement by a plurality of bolts.

In the prior art gear pump described above, it is essential that the journal openings within the housing and endcap which receive the opposite axial ends of the shafts be as nearly concentric (co-axial) as possible. Typically, in order to achieve such concentricity, a plurality of alignment pins (e.g., dowel pins) is received within bores defined by the housings and the endcap. As is well known to those skilled in the art, in order to achieve the objective of improved concentricity and alignment, the location and size of the pin bores relative to each other must be maintained very accurately. Furthermore, the size of the pin bores relative to the size of the pins must be machined within a very close tolerance. Such an arrangement adds substantial machining complexity and expense to the typical gear pump.

In the prior art arrangement described above, the fact that one end (rearward end) of each of the shafts extends into the endcap results in an endcap which is excessively thick in the axial direction, requires substantial machining, and becomes relatively heavy and expensive (in terms of both the amount of material and the machining required).

Another disadvantage of the prior art gear pump of the type described above is the extreme difficulty of making field conversions with regard to items such as the input shaft type, length, and diameter, and the direction of rotation of the pump. Also, it is not economically feasible with the conventional, commercially available gear pumps, to convert a standard (one pumping element) pump to a tandem plump by the addition of a second pumping section.

SUMMARY OF THE INVENTION

Accordingly, it is an object of the present invention to provide an improved fluid pressure device of the pump or motor type which overcomes the above-described disadvantages of the typical prior art gear device.

It is a more specific object of the present invention to provide an improved gear pump in which all of the primary surfaces which are required to be concentric, relative to each other, are defined by a single housing member, thus eliminating the need to utilize the expensive prior art alignment technique described above.

It is a related object of the present invention to provide an improved gear pump which accomplishes the above-stated objects, while at the same time providing greater flexibility with regard to input shaft diameter and length, side load to which the input shaft can be subjected, and direction of rotation of the device.

It is another related object of the present invention to provide an improved gear pump which is able to achieve the above-stated objects in such a way that converting the standard pump to a tandem pump, by adding an additional pumping section, is greatly simplified, and results in a total tandem pump assembly which is substantially more compact, simpler, and less expensive than the prior art tandem pump. A further related object of the present invention is to provide such capability of converting to a tandem pump, even in the field, without total disassembly of the standard pump.

The above and other objects of the invention are accomplished by the provision of a rotary gear device useable as a pump or motor, the device being of the type comprising a housing defining an inlet port and an outlet port and first and second gear cavities defining first and second axes of rotation, respectively. First and second gears are rotatably disposed in the gear cavities and are rotatable about the first and second axes of rotation, and have gear teeth intermeshing. An inlet chamber is at one side of the intermeshing teeth and in fluid communication with the inlet port, and an outlet chamber is at the other side of the intermeshing teeth, and in fluid communication with the outlet port. A shaft means is operably associated with the first gear whereby rotation of the shaft means causes rotation of the first and second gears, and rotation of the first and second gears causes rotation of the shaft means. The device includes means operable to support the shaft means for rotation relative to the housing.

The improved rotary gear device is characterized by each of the first and second gears comprising a gear portion and a generally cylindrical portion disposed on one axial side of the gear portion. The housing defines first and second generally cylindrical, internal pilot surfaces, disposed concentrically about the first and second axes of rotation, respectively. The first and second internal pilot surfaces receive and rotatably support the cylindrical portions of the first and second gears, respectively. The engagement of each of the cylindrical portions and its respective internal pilot surface comprises substantially the only bearing support for the first and second gears.

DESCRIPTION OF THE PREFERRED EMBODIMENT

Figure 1:
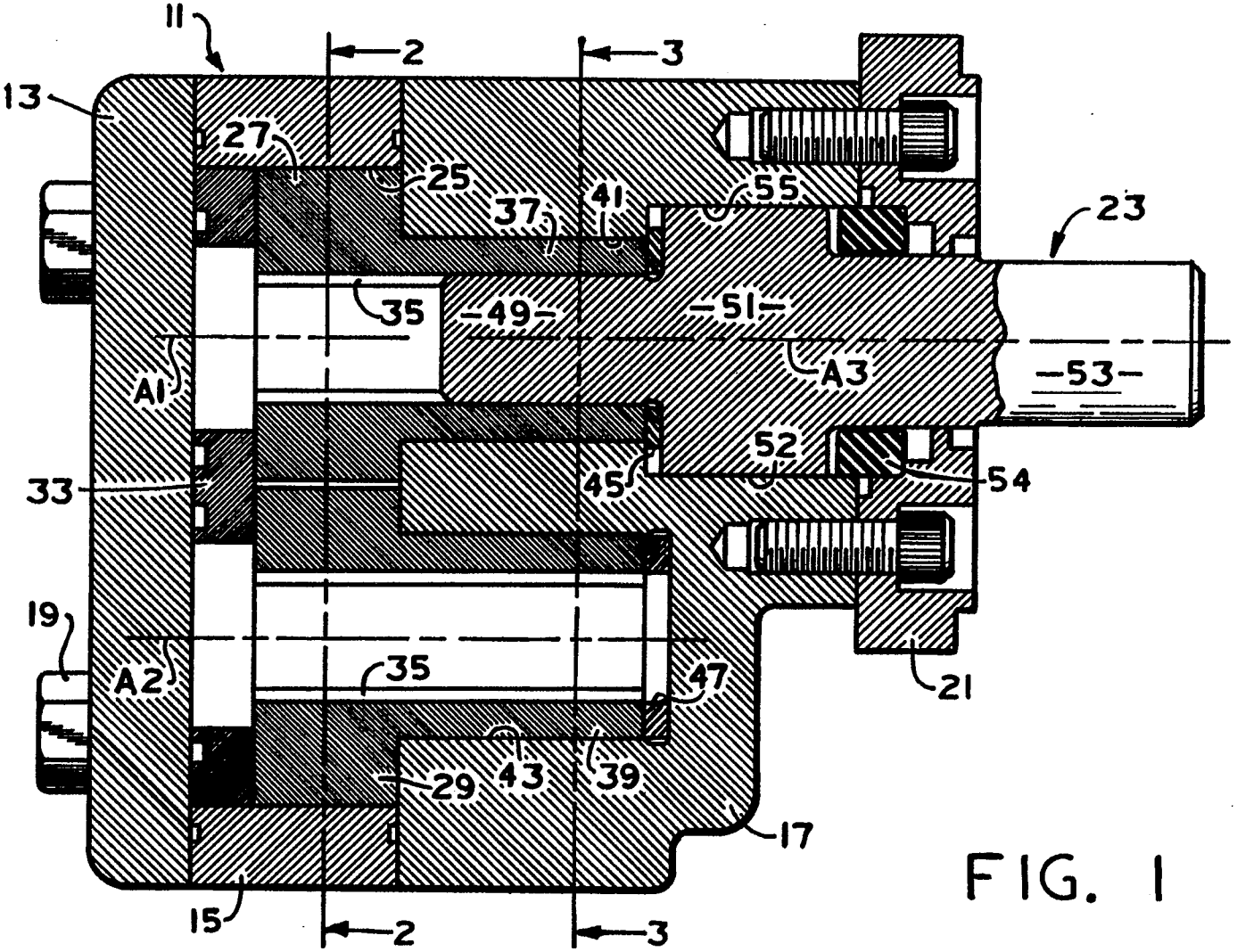
FIG. 1 is an axial cross-section of an improved gear pump made in accordance with the present invention.

Referring now to the drawings, which are not intended to limit the invention, FIG. 1 is an axial cross-section of a gear pump, generally designated 11, made in accordance with the teachings of the present invention. The gear pump 11 comprises a plurality of sections including an endcap 13, a gear housing member 15, and a pilot housing 17. For some purposes in this specification and in the appended claims, the term "housing" will include both the housing member 15 and the pilot housing 17. The endcap 13, the gear housing member 15, and the pilot housing 17 are held in tight, sealing engagement by means of a plurality of bolts 19, only two of which are shown in FIG. 1, but all four of which are shown in each of FIGS. 2 and 3.

Attached to the forward end (right end in FIG. 1) of the pilot housing 17 is a flange member 21 which, as is well known to those skilled in the art, is typically utilized to mount the pump 11 relative to the structure with which it is associated. Extending through an opening defined by the flange member 21 is an input shaft 23, it being understood that the shaft 23 can comprise an output shaft if the device is utilized as a motor.

Figure 2:
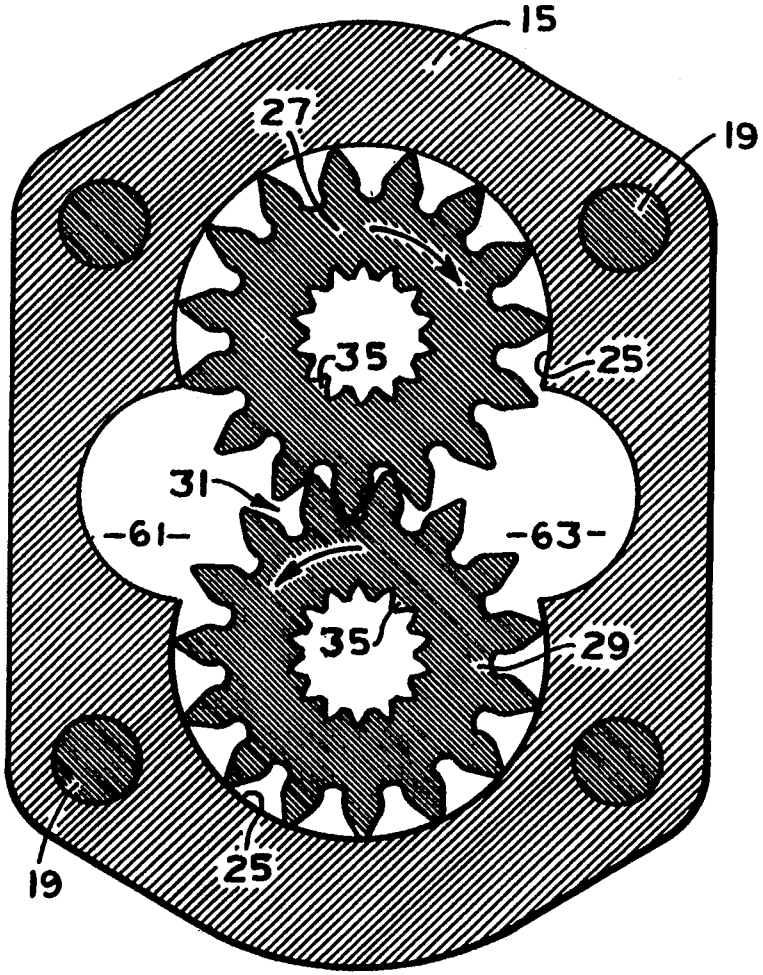
FIG. 2 is a transverse cross-section, taken on line 2—2 of FIG. 1, and on approximately the same scale.

Referring now primarily to FIGS. 1 and 2, it may be seen that the gear housing member 15 defines a generally figure-8 shaped gear chamber 25, and rotatably disposed therein, is a drive gear 27 and a driven gear 29. In the subject embodiment, the gears 27 and 29 comprise straight spur gears, with the teeth having an involute profile. Furthermore, in the subject embodiment, each of the gears 27 and 29 has 15 gear teeth, thus reducing the flow ripple of the gear mesh, generally designated 31, and reducing the fluid borne noise of operation of the gear mesh 31.

Disposed adjacent the rearward end (left end in FIG. 1) of the gears 27 and 29 is a balancing plate 33. In most pressure operated devices (either a pump or a motor) of the gear type, it is important to have some sort of pressure balancing mechanism disposed adjacent the gear set. However, such balancing plates are well known to those skilled in the art, the particular configuration of the balancing plate 33 is not an essential feature of the present invention, and therefore, the balancing plate 33 is not illustrated or described further herein.

Preferably, although not essential to the present invention, the endcap 13 and pilot housing 17 comprise cast iron members, while the gear housing member 15 comprises an aluminum die casting. It is also preferable, for reasons which will become apparent subsequently, that the drive gear 27 and driven gear 29 comprise PM (powdered metal) members.

Figure 3:
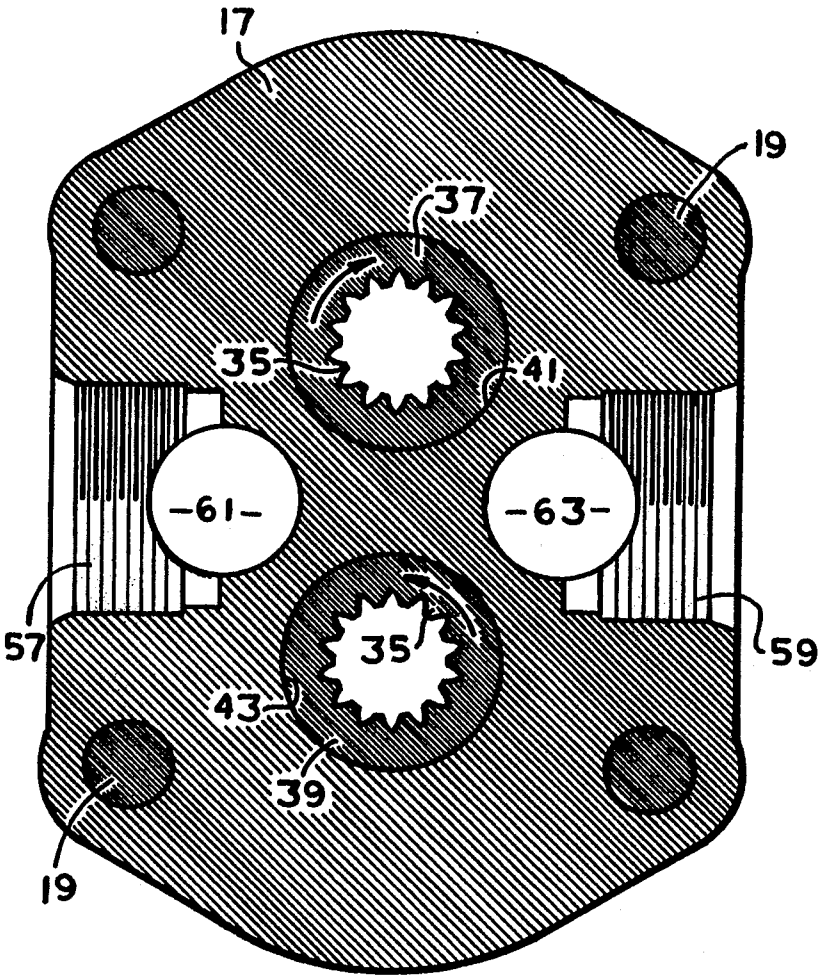
FIG. 3 is a transverse cross-section taken on line 3—3 of FIG. 1, and on approximately the same scale.

Referring now to FIGS. 2 and 3, in conjunction with FIG. 1, it may be seen that the drive gear 27 and driven gear 29 may be substantially identical, such that during the manufacturing process, the gears 27 and 29 would actually bear the same part number, thus simplifying the inventory and assembly processes. For clarity of explanation, however, the gears 27 and 29 will be described as though they are different parts. Each of the gears 27 and 29 defines a set of internal splines 35. As may best be seen in FIG. 1, the internal splines 35 defined by the driven gear 29 are, in actuality, superfluous, but if the gears 27 and 29 are identical and are formed of PM, the internal splines 35 are essentially free. In that case, the manufacturing economy resulting from the gears 27 and 29 being identical justifies the manufacture of a set of internal splines on every gear made, when the splines will subsequently be used in only one-half of the gears.

Referring now primarily to FIGS. I and 3, the drive gear 27 includes an integral, generally cylindrical portion 37, and similarly, the driven gear 29 includes an integral, generally cylindrical portion 39. The pilot housing 17 defines a cylindrical pilot surface 41, which receives and pilots the cylindrical portion 37, and similarly, the pilot housing 17 defines a cylindrical pilot surface 43 which receives and pilots the cylindrical portion 39. Disposed adjacent the forward end of the cylindrical portion 37 is an annular thrust bearing 45, and similarly, disposed adjacent the forward end of the cylindrical portion 39 is an annular thrust bearing 47. The thrust bearing 45 must be annular and define a central opening, because of the input shaft 23, but the thrust bearing 47 may either comprise a solid, circular member, or be the same as the thrust bearing 45. In either case, both of the thrust bearings 45 and 47 preferably comprise a bearing bronze type of material, or steel coated with polytetrafluoroethylene, or some other functionally-equivalent material.

Referring again primarily to FIG. 1, the input shaft, generally designated 23, comprises a rearward, splined portion 49, a central bearing portion 51 defining a cylindrical bearing surface 52, and a forward shaft portion 53 having a thrust bearing surrounding the shaft portion 53, and disposed axially between the flange member 21 and the central bearing portion 51. As shown in FIG. 1, the portions 49, 51, and 53 are preferably formed as one integral piece, such that the various recited portions merely comprise different diameters. The splined portion 49 may comprise a conventional spline fit with the internal splines 35 of the drive gear 27 although, preferably, there should not be a substantial amount of backlash between the portion 49 and the internal splines 35.

The pilot housing 17 defines a cylindrical pilot surface 55, and disposed therein is the bearing portion 51. Preferably, there is a journal bearing fit between the bearing surface 52 and the pilot surface 55. Similarly, there is preferably a journal bearing fit between the cylindrical portion 37 and the pilot surface 41, as well as between the cylindrical portion 39 and the pilot surface 43. As is well known to those skilled in the art, but by way of example only, a journal bearing fit would typically be understood to comprise a diametral clearance between the pilot surface and the cylindrical portion, of about 0.0002 inches (0.0050 mm.) to about 0.0010 inches (0.0254 mm.). It will be apparent to those skilled in the art that lubrication is necessary for the various journal bearing fits described above, and may in fact be essential to good performance and durability of the gear pump. However, it is believed to be within the ability of those skilled in the art to provide some means for suitable lubrication, and the particular lubrication arrangement to be utilized is not an essential feature of the present invention.

It is one important aspect of the 13resent invention to provide a gear pump design which permits substantially greater flexibility in regard to the input shaft 23. For example, because the input shaft 23 is separate from the drive gear 27, and transmits torque thereto by means of the spline portion 49 and internal splines 45, the diameter of the shaft portion 53 is not limited by the size of the gears. Conventional S.A.E. "A" mount gear pump input shafts have a $\frac{3}{4}$ inch to $\frac{7}{8}$ inch diameter, because of the limitations imposed by the size of the gears. However, in the subject embodiment, the shaft portion 53 has a diameter of approximately one inch, and as may be seen in FIG. 1, that diameter could be increased even further if it would be desirable to do so.

Because the present invention permits the use of a larger diameter shaft portion 53, the subject embodiment includes a flange member 21 which is already in commercial production by the assignee of the present invention in connection with its gerotor motor sold commercially under the designation "H" motor. That commercially available flange member, already adapted for a one-inch diameter shaft, comes in either two-bolt or four-bolt versions, and is readily available through many distributors of hydraulics products.

Furthermore, in regard to the flexibility provided by the present invention, if it were desired, "in the field", to replace the input shaft 23 with one having a different diameter or a different length, all that would be required would be to remove the flange member 21 and slide the input shaft out of the pilot housing 17, disengaging the splined portion 49 from the internal splines 45. The alternative input shaft would then be installed, and the appropriate, or corresponding flange member bolted in place, completing the retrofit. As is well known to those skilled in the art, such a retrofit on the gear pump of the type shown in above-incorporated U.S. Pat. No. 3,713,759 is impossible, because the input shaft is typically pressed into the drive gear. In order to remove the gear from the input shaft, the entire pump must first be disassembled.

Referring now primarily to FIGS. 2 and 3, the pilot housing 17 defines an inlet port 57 and an outlet port 59. In communication with the inlet port 57 is an inlet chamber 61, and in communication with the outlet port 59 is an outlet chamber 63, both of the chambers 61 and 63 being shown in both FIGS. 2 and 3. With the input shaft 23 rotating clockwise, and thus causing clockwise rotation of the drive gear 27, the driven gear 29 rotates counter-clockwise (see arrows in FIGS. 2 and 3). The teeth of the gears 27 and 29 carry fluid from the inlet chamber 61 around the gear chamber 25 and out the outlet chamber 63 to the outlet port 59.

Referring again to FIG. 1, it may be seen that the drive gear 27 defines an axis of rotation A1 while the driven gear 29 defines an axis of rotation A2. Finally, the input shaft 23 defines an axis of rotation A3. All three of the axes of rotation are intended to be parallel to each other, and the axes of rotation A1 and A3 preferably coincide, although such is clearly not essential to the present invention. The three pilot surfaces 41, 43, and 55 which are critical in terms of alignment of the various elements are intended to be concentric about the axes of rotation A1, A2, and A3, respectively. In accordance with one important aspect of the present invention, because the three pilot surfaces 41, 43, and 55 are all formed within a single element (the pilot housing 17), it is much easier and less expensive in terms of machining, to be able to maintain nearly perfect concentricity and alignment among those three pilot surfaces. In addition, the pilot surfaces are all near each other, axially, rather than being on axially opposite sides of the gear set, and therefore axially displaced by a substantial distance, as is the case in the conventional prior art gear pump. Thus, it may be seen that one advantage of the invention is the elimination of the need for dowel pins, which are typically needed in the prior art gear pump to align the various housing sections, and the bores defined thereby, which need to be concentric.

In the gear pump of the present invention, sideloads which are applied to the input shaft 23 are taken up between the bearing surface 52 of the bearing portion 51 and the pilot surface 55, and are not transmitted to the gears, as in prior art gear pump designs. As a result, it has been found, in connection with the development of the present invention, that the deflection of the gears (i.e., the movement in the plane of FIG. 2) is less than in the prior art gear pump. In other words, even though each of the gears 27 and 29 is mounted and supported in a cantilever fashion (i.e., supported only on one end), the deflection of each of the gears 27 and 29 is less than what typically occurs in the prior art gear pump in which the gear shafts are supported on both axial ends, but are supported within journal openings defined by different members and which are therefore subject to mis-alignment, as was described in the BACKGROUND OF THE DISCLOSURE.

Alternatives

Although each of the gears 27 and 29 is shown as being formed integrally with the cylindrical portions 37 and 39, respectively, the invention is not so limited. As an alternative, it would be possible for each gear and its cylindrical portion to comprise two separate members, as long as the overall "cantilever" approach is still used. For example, it would be feasible to use a PM gear and a hollow steel shaft, defining the internal splines 35, with the shaft being pressed into the PM gear. One advantage of this alternative would be the potential of a better journal bearing arrangement between the steel shaft and the cast iron pilot housing 17.

Another alternative which is possible with the present invention points out an additional advantage of the invention. Frequently, it is desirable to provide customers with a "tandem" pump arrangement, i.e., a pump having a single inlet port, but two separate and distinct outlet ports. A typical tandem pump includes two separate pumping elements, each being connected to one of the outlet ports. The present invention is especially suited to providing a tandem pump, because it requires no gear shafts to be supported on axially opposite ends of the gears, as in the prior art gear pump.

With the gear pump of the present invention, conversion of the pump shown in FIG. 1 to a tandem pump would merely require the removal of the endcap 13 and the bolts 19, and the addition of an externally splined adaptor engaging the internal splines 35 of the gear 27. Subsequently, a short pilot housing would be added, then a gear housing member and two gears (which could be identical to the drive gear 27 and driven gear 29). Finally, another balancing plate 33 would be added, and the endcap 13 would be replaced, with the original bolts 19 being replaced by substantially longer bolts. Those skilled in the art will understand that such a conversion from a single element pump to a tandem pump is, with the typical prior art gear pump, virtually impossible, especially as an "in the field" conversion.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A rotary gear device usable as a pump or motor, the device being of the type comprising a housing defining an inlet port and an outlet port, and first and second gear cavities, defining first and second axes of rotation, respectively; first and second gears rotatably disposed in said first and second gear cavities, respectively, and rotatable about said first and second axes of rotation, respectively, and having gear teeth intermeshing; an inlet chamber at one side of the intermeshing teeth and in fluid communication with said inlet port, and an outlet chamber at the other side of the intermeshing teeth, and in fluid communication with said outlet port; a shaft means operably associated with said first gear, and disposed toward a forward end of said gear device, whereby rotation of said shaft means causes rotation of said first and second gears, and rotation of said first and second gears causes rotation of said shaft means; means operable to support said shaft means for rotation relative to said housing; characterized by:

(a) each of said first and second gears comprises a gear portion and a generally cylindrical forward portion disposed on the forward axial side of said gear portion;

(b) said housing defining first and second generally cylindrical, internal pilot surfaces, disposed concentrically about said first and second axes of rotation, respectively;

(c) said first and second internal pilot surfaces receiving and rotatably supporting said cylindrical forward portions of said first and second gears, respectively; and (d) the engagement of each of said cylindrical forward portions and its respective internal pilot surface comprising substantially the only bearing support for said first and second gears.

2. A rotary gear device as claimed in claim 1, characterized by said housing defining a third generally cylindrical, internal pilot surface, disposed concentrically about said first axis of rotation, said first internal pilot surface being disposed axially between said first gear cavity and said third internal pilot surface; and said shaft means including a shaft portion and a cylindrical portion received and rotatably supported by said third internal pilot surface.

3. A rotary gear device as claimed in claim 2, characterized by the engagement of said cylindrical portion of said shaft means and said third internal pilot surface comprises a major portion of the bearing support for said shaft means.

4. A rotary gear device as claimed in claim 1, characterized by said device further comprising an endcap member attached to said housing on the axial side of said first and second gears opposite said first and second internal pilot surfaces.

5. A rotary gear device as claimed in claim 4, characterized by said device further comprising a balancing plate disposed axially between said endcap and said first and second gears, said balancing plate being disposed in operable engagement with said gear portions of said first and second gears.

6. A rotary gear device as claimed in claim 1, characterized by said generally cylindrical forward portion of said first gear comprising a central opening defining a set of internal splines, and said shaft means further comprises a set of external splines in engagement with said internal splines, the engagement of said internal and external splines comprising said operable association of said shaft means and said first gear.

7. A rotary gear device as claimed in claim 6, characterized by said first and second gears being substantially identical and interchangeable.

8. A rotary gear device as claimed in claim 6, characterized by said housing defining a third generally cylindrical, internal pilot surface, disposed concentrically about said first axis of rotation, said shaft means including a shaft portion extending axially outside said device, and an enlarged, generally cylindrical portion disposed axially between said shaft portion and said external splines, said cylindrical portion being received and rotatably supported by said third internal pilot surface.

9. A rotary gear device as claimed in claim 8, characterized by the engagement of said enlarged cylindrical portion of said shaft means and said third internal pilot surface comprises a major portion of the side-load bearing support for said shaft means.

10. A rotary gear device as claimed in claim 8, characterized by said housing comprises a main housing member and a flange member adapted for mounting said device to a structure, said flange member defining an opening through which said shaft portion extends, and thrust bearing means being disposed axially between said flange member and said enlarged, generally cylindrical portion of said shaft means.

11. A rotary gear device usable as a pump or motor, the device being of the type comprising a housing defining an inlet port and an outlet port, and first and second gear cavities, defining first and second axes of rotation, respectively; first and second gears rotatably disposed in said first and second gear cavities, respectively, and rotatable about said first and second axes of rotation, respectively, and having gear teeth intermeshing; an inlet chamber at one side of the intermeshing teeth and in fluid communication with said inlet port, and an outlet chamber at the other side of the intermeshing teeth, and in fluid communication with said outlet port; a shaft means operably associated with said first gear, whereby rotation of said shaft means causes rotation of said first and second gears, and rotation of said first and second gears causes rotation of said shaft means; means operable to support said shaft means for rotation relative to said housing; characterized by:

(a) each of said first and second gears consisting essentially of a gear portion and one generally cylindrical portion disposed on one axial side of said gear portion;

(b) said housing defining first and second generally cylindrical, internal pilot surfaces, disposed concentrically about said first and second axes of rotation, respectively;

(c) said first and second internal pilot surfaces receiving and rotatably supporting said cylindrical portions of said first and second gears, respectively; and (d) the engagement of each of said cylindrical portions and its respective internal pilot surface comprising substantially the only bearing support for said first and second gears.

12. A rotary gear device as claimed in claim 11, characterized by said housing defining a third generally cylindrical, internal pilot surface, disposed concentrically about said first axis of rotation, said first internal pilot surface being disposed axially between said first gear cavity and said third internal pilot surface; and said shaft means including a shaft portion and a cylindrical portion received and rotatably supported by said third internal pilot surface.

13. A rotary gear device as claimed in claim 12, characterized by the engagement of said cylindrical portion of said shaft means and said third internal pilot surface comprises a major portion of the bearing support for said shaft means.

14. A rotary gear device as claimed in claim 11, characterized by said device further comprising an endcap member attached to said housing on the axial side of said first and second gears opposite said first and second internal pilot surfaces.

15. A rotary gear device as claimed in claim 14, characterized by said device further comprising a balancing plate disposed axially between said endcap and said first and second gears, said balancing plate being disposed in operable engagement with said gear portions of said first and second gears.

16. A rotary gear device as claimed in claim 11, characterized by said generally cylindrical portion of said first gear comprising a central opening defining a set of internal splines, and said shaft means further comprises a set of external splines in engagement with said internal splines, the engagement of said internal and external splines comprising said operable association of said shaft means and said first gear.

17. A rotary gear device as claimed in claim 16, characterized by said first and second gears being substantially identical and interchangeable.

18. A rotary gear device as claimed in claim 16, characterized by said housing defining a third generally cylindrical, internal pilot surface, disposed concentrically about said first axis of rotation, said shaft means including a shaft portion extending axially outside said device, and an enlarged, generally cylindrical portion disposed axially between said shaft portion and said external splines, said cylindrical portion being received and rotatably supported by said third internal pilot surface.

19. A rotary gear device as claimed in claim 18, characterized by the engagement of said enlarged cylindrical portion of said shaft means and said third internal pilot surface comprises a major portion of the side-load bearing support for said shaft means.

20. A rotary gear device as claimed in claim 18, characterized by said housing comprises a main housing member and a flange member adapted for mounting said device to a structure, said flange member defining an opening through which said shaft portion extends, and thrust bearing means being disposed axially between said flange member and said enlarged, generally cylindrical portion of said shaft means.

* * * * *